United States Patent [19]

Hubbert

[11] 4,098,567

[45] Jul. 4, 1978

[54] RECIRCULATING PROCESSING OVEN HEATER

[75] Inventor: Gordon F. Hubbert, Plymouth, Mich.

[73] Assignee: Gladd Industries, Inc., Detroit, Mich.

[21] Appl. No.: 728,659

[22] Filed: Oct. 1, 1976

[51] Int. Cl.[2] ..... F23J 15/00

[52] U.S. Cl. ..... 432/72; 431/115; 432/223

[58] Field of Search ..... 432/72, 29, 38, 48, 432/49, 222, 223; 34/26, 34, 35, 54, 72, 79, 86, 219, DIG. 7; 110/8 A; 23/277 C, 288 F, 288 FA; 431/5, 115, 116, 10; 239/432

[56] References Cited

U.S. PATENT DOCUMENTS

| | | | |
|---|---|---|---|
| 2,268,464 | 12/1941 | Seippel | 432/223 |
| 2,658,742 | 11/1953 | Suter et al. | 432/72 |
| 2,743,529 | 5/1956 | Hayes | 432/72 |
| 2,750,680 | 6/1956 | Hondry et al. | 432/72 |
| 2,985,438 | 5/1961 | Prowler | 432/223 |
| 3,130,961 | 4/1964 | Verner et al. | 432/72 |
| 3,146,821 | 9/1964 | Wuetig | 431/115 |
| 3,285,007 | 11/1966 | Carlisle et al. | 239/432 |
| 3,368,604 | 2/1968 | Mutchler | 431/263 |
| 3,604,824 | 9/1971 | Hardison | 432/72 |
| 4,017,254 | 4/1977 | Jones | 432/72 |
| 4,021,192 | 5/1977 | Ferguson et al. | 432/72 |

*Primary Examiner*—John J. Camby
*Assistant Examiner*—Henry C. Yuen
*Attorney, Agent, or Firm*—Reising, Ethington, Barnard, Perry & Brooks

[57] ABSTRACT

A recirculating processing oven heater including a direct fired burner for heating processing gas and a catalytic converter downstream from the burner for removing unburned combustible gas and providing additional heating prior to delivery of the processing gas to an associated processing oven. A housing of the heater defines first and second parallel paths along which the gas flows between an inlet and an outlet thereof and the burner and catalytic converter are located along the first path to heat gas flowing therealong while mixing of the gas downstream therefrom at a junction of the two paths provides heating of the gas that flows along the second path. The relative mass flow rates of gas flowing along the first and second paths is adjustable by a control valve mechanism including first and second adjustable valves at the inlet of the heater housing. Inner and outer housing portions of the heater housing have hollow elongated shapes with round cross sections and are arranged in a coaxial relationship such that the inner housing portion defines the first gas flow path and the space between the inner and outer housing portions defines the second gas flow path. An upstream end of the inner housing portion receives the burner while a downstream end thereof mounts a conical mixing member for causing mixing of the gas from the two paths.

5 Claims, 5 Drawing Figures

RECIRCULATING PROCESSING OVEN HEATER

BACKGROUND OF THE INVENTION

1. Field of the Invention

This invention relates to a recirculating processing oven heater for use in heating processing gas as it is recirculated from the heater to an associated oven and back to the heater in a cyclical manner.

2. Description of the Prior Art

Processing ovens such as paint ovens and ovens for meat processing systems require recirculating heaters that will heat processing gas without introducing any contaminative gas components such as unburned combustible gases in the form of unburned hydrocarbons or carbon monoxide, etc. In order to provide this heating of processing gas without introducing contaminants, prior art heaters of this type have utilized a burner and a heat exchanger so that there is no direct contact between the burning flame and the processing gas being heated. The heat exchanger provides isolation of the burner flame and the processing gas so that unburned fuel such as natural gas or oil does not become introduced into the processing gas. While heat exchangers of this type provide uncontaminated heating of processing gas, the maximum efficiency of the heat exchangers is on the order of 60% and much of the heat from the burner flame is thus wasted. Increasing scarcity of fuels and their consequent ever increasing cost have made this wasted heat a significant cost factor in operating a processing oven heater.

SUMMARY OF THE INVENTION

An object of the present invention is to provide a recirculating processing oven heater that may be operated efficiently by incorporating a direct fired burner that heats the processing gas while in direct contact therewith and a catalytic converter downstream from the burner for removing unburned combustible gas components from the processing gas while providing additional heating thereof prior to delivery to an associated oven.

In carrying out the above object and other objects of the invention, the heater includes a housing that defines first and second parallel paths along which the processing gas flows from an inlet of the heater housing toward an outlet of the housing. The burner and the catalytic converter are located along the first path such that gas flowing therealong is heated and subsequently mixed at a downstream junction of the two paths prior to being delivered to the outlet. By heating only a portion of the processing gas flowing through the heater, the temperature of the gas passing through the catalytic converter can be maintained in the 600°-1200° F range so that there is effective operation of the catalytic converter while still delivering heated processing gas after mixing in the usable 150°-500° F range. Inefficiencies resulting from the indirect burners and heat exchangers previously utilized in this type of heater are thus eliminated without introducing contaminants and while still providing processing gas that has a usable temperature. Any oxidizing catalysts utilizing a precious metal like platinum and/or palladium etc. as the catalytic agent may be used in the catalytic converter to remove the combustible gases from the processing gas while providing the additional heating.

A control valve mechanism of the heater is located at its housing inlet and includes first and second valves for controlling the relative mass flow rates of gas along the first and second paths of the housing. Each valve includes a plurality of dampers and an actuator for positioning the dampers in an adjustable manner that controls the gas flow. The actuator of the first valve is power operated in response to the temperature of the processing gas within the oven fed by the heater in order to control the mass flow rate of gas flowing along the first path by the burner and through the catalytic converter. The actuator of the second valve is manually adjustable to control the mass flow rate of gas along the second path.

Inner and outer hollow housing portions of the heater housing have elongated shapes with round cross sections arranged in a coaxial relationship. The inner housing portion defines the first gas flow path and has one upstream end that receives the burner and a downstream end located adjacent a mixing chamber defined by the outer housing portion. The catalytic converter is located between the upstream and downstream ends of the inner housing portion preferably closer to the downstream end and a mixing member is mounted on the downstream end so as to cause radial flow of the gas from the first path in a manner that causes it to mix within the mixing chamber with the gas flowing along the second path. The mixing member has a conical shape that points from the downstream end of the inner housing portion toward the burner at its upstream end and is supported on the inner housing portion by axial supports that are spaced circumferentially. Radial supports also spaced circumferentially extend between the inner and outer housing portions to mount the inner housing portion within the outer housing portion in the spaced relationship that defines the second gas flow path between the housing portions. At the upstream end of the inner housing portion, a wall extends between the inner and outer housing portions and to between the first and second valves of the valve mechanism in order to define the first and second flow paths adjacent the inlet of the housing.

Insulating material is utilized to form the outer housing portion in a manner that prevents heat loss from the heater. Noninsulating material which preferably is stainless steel is utilized to form the inner housing portion since any heat loss from this inner housing portion does not escape to the environment but rather warms the gas flowing along the second flow path between the inner and outer housing portions. A first annular baffle of a flat construction is mounted within the inner housing portion extending in an inward direction between the burner and the catalytic converter to ensure the generation of a sufficient gas pressure about the burner during heating. A second annular baffle of a flat construction is mounted on the outer housing portion upstream from the mixing chamber to provide gas flow with a sufficient pressure along the second path so that it receives heat conducted outwardly from the burner heated gas flowing along the first path within the inner housing portion. An adjustable fresh air inlet in the outer housing portion upstream from its annular baffle provides for the introduction of fresh air into the heater for mixing with the air being recirculated from the processing oven. Downstream of the mixing chamber defined by the outer housing portion, a suction blower sucks the heated gas that has been mixed within the chamber from both flow paths and feeds the gas to the outlet of the heater housing ready for delivery to the oven.

The objects, features and advantages of the present invention are readily apparent from the following detailed description of the preferred embodiment taken in connection with the accompany drawings.

DETAILED DESCRIPTION OF THE PREFERRED EMBODIMENT

Figure 1:
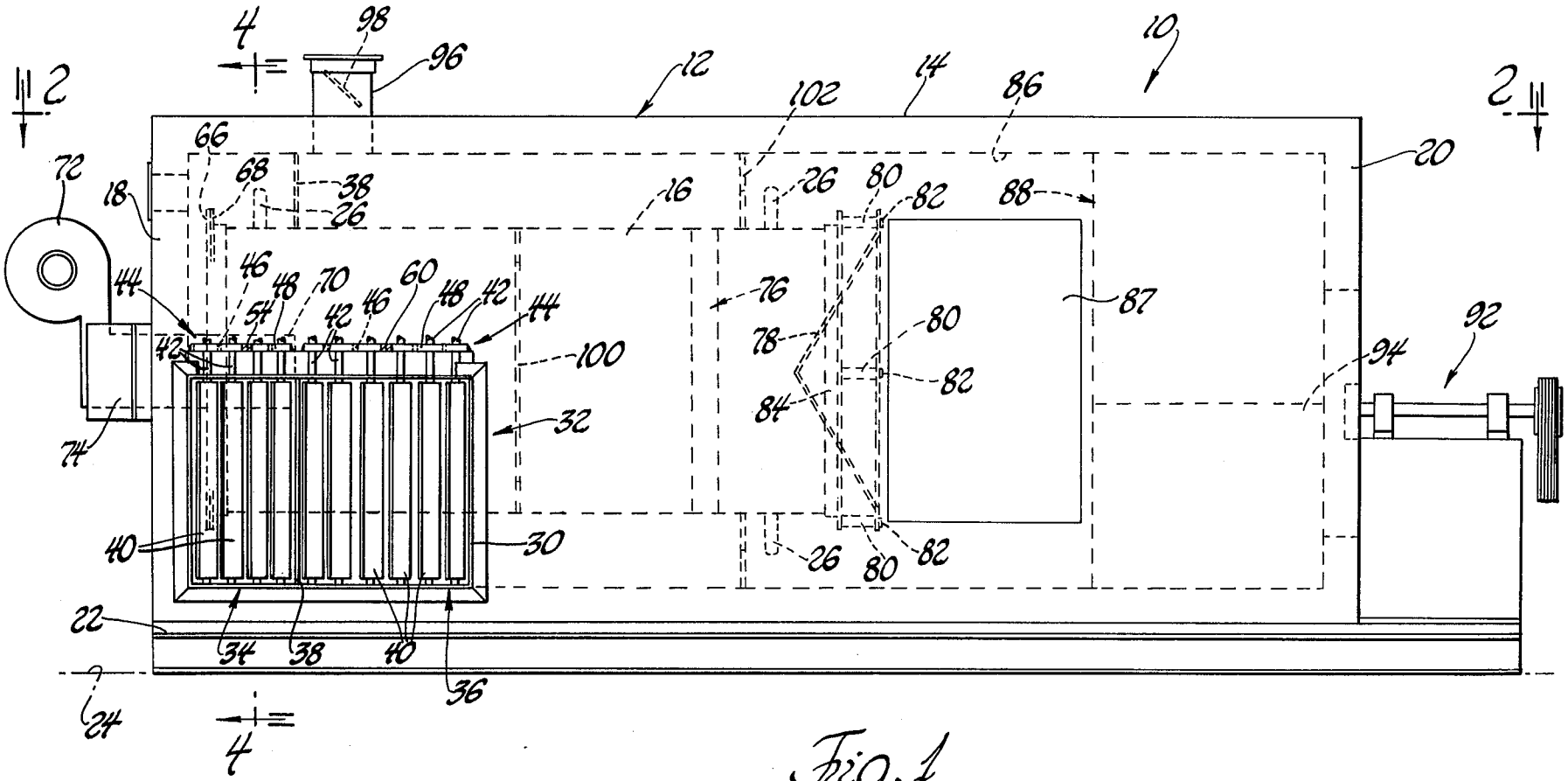
FIG. 1 is a side elevation view of a recirculating processing oven heater constructed according to the present invention.

Referring to FIG. 1 of the drawings, a recirculating processing oven heater constructed according to the present invention is indicated by reference numeral 10 and includes an elongated housing 12 having a hollow outer housing portion 14 and a hollow inner housing portion 16 received within the outer housing portion. The inner housing portion 16 is located closer to a first end wall 18 of the outer housing portion 14 than to a second end wall 20 of the outer housing portion. A base framework 22 mounts the outer housing portion 14 on the floor 24. Outer housing portion 14 and inner housing portion 16 each have a round cross section shown in FIG. 4. Radial supports 26 that are spaced circumferentially with respect to each other extend between the outer and inner housing portions 14 and 16 to locate the inner housing portion in a coaxial relationship with respect to the outer housing portion. Suitable insulating material is used to construct the outer housing portion 14 while the inner housing portion 16 is constructed from metallic material that is preferably stainless steel. A gas inlet 28 (FIG. 4) in outer housing portion 14 is fed processing gas returned from an associated processing oven in a manner that is hereinafter described through a duct 30 under the control of a valve mechanism 32.

Figure 2:
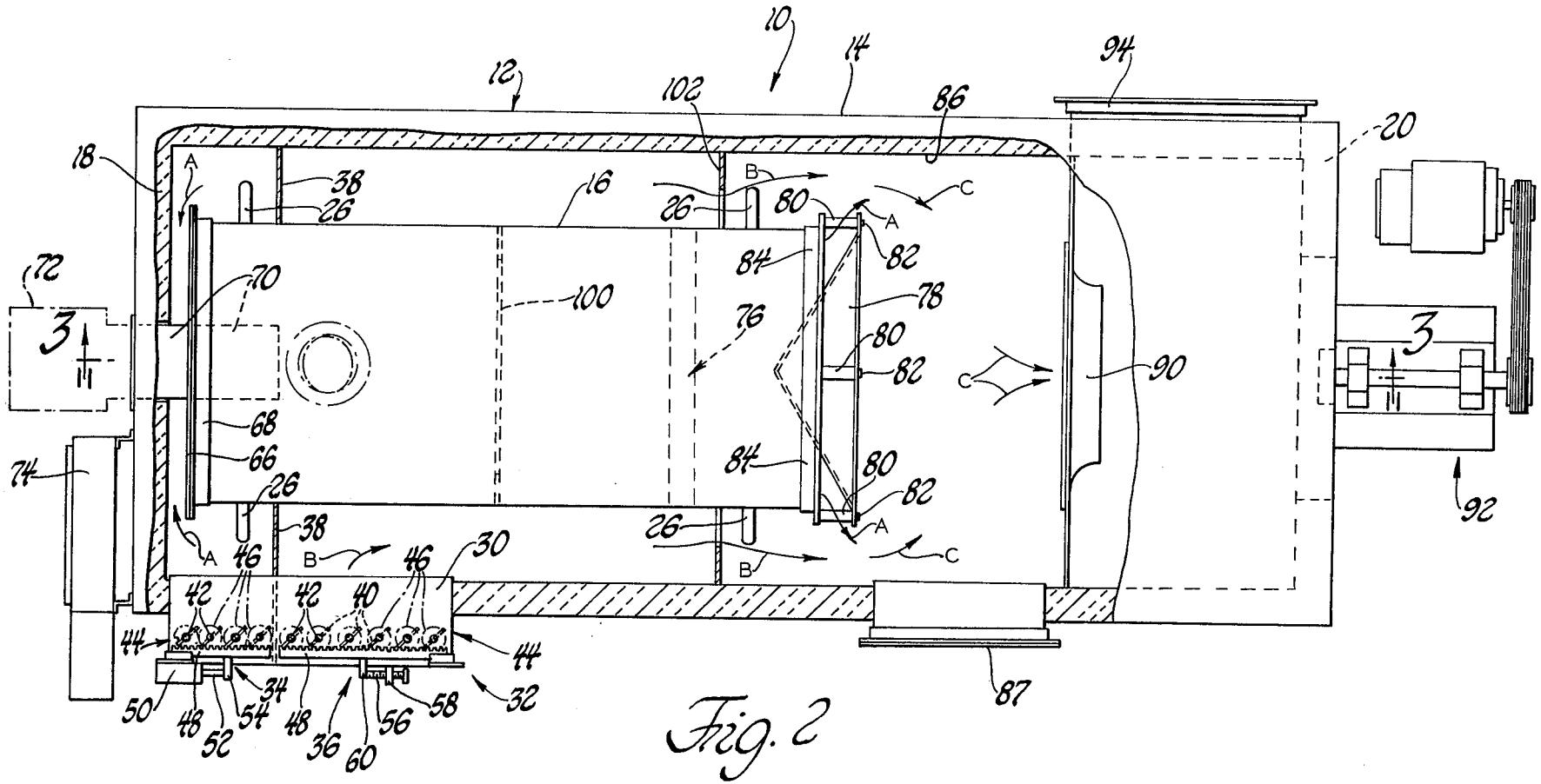
FIG. 2 is a partially broken away top plan view of the heater taken along line 2—2 of FIG. 1.

As seen by combined reference to FIGS. 1 and 2, valve mechanism 32 includes first and second valves 34 and 36 located on opposite sides of an intermediate wall 38 of the inlet duct 30. Wall 38 extends inwardly from duct 30 and has an annular shape that divides the space between the inner and outer housing portions 14 and 16 such that a certain portion of the gas from duct 30 flows along a first path of the housing through the inner housing portion 16 as shown by arrows A and a certain portion of the gas flows along a second path of the housing between the inner and outer housing portions as shown by arrows B. Valves 34 and 36 are adjustable in order to control the relative mass flow rates of gas flowing along the two paths of the housing. Each valve includes a plurality of vertically elongated dampers 40 mounted on associated vertical shafts 42 that are pivotally supported by upper and lower walls of the inlet duct 30. An actuator 44 of each valve includes pinion gears 46 respectively mounted on the upper ends of shafts 42 and a rack 48 engaged with gears 46. The actuator 44 for the first valve 34 includes a power operated fluid cylinder 50 (FIG. 2) having a piston connecting rod 52 fixed to a projection 54 on the associated gear rack 48 in order to cause movement of the rack and consequent pivoting of the gears 46 so that shafts 42 are moved in a manner that controls the position of the dampers 40. The actuator 44 of the second valve 36 includes a manually adjustable screw 56 (FIG. 2) threaded through a fixed support 58 and connected to a projection 60 on the associated gear rack 48 so as to likewise cause gear rack movement that pivots the associated gears 46 and thereby moves the shafts 42 in order to position the associated dampers 40. This positioning of the dampers 40 of the two valves 34 and 36 of valve mechanism 32 thus controls the mass flow rate of the gas A and B flowing along the first and second paths of the heater housing.

The valve actuators 44 of valves 34 and 36 may alternately be constructed with the damper shaft gears 46 of each valve intermeshed and driven by an associated linkage. A power operated linkage would be used with the actuator 44 for valve 34, while a manually adjustable linkage would be used with the actuator 44 for valve 36. Likewise, other valve structures and actuators familiar to those skilled in the art may be used.

Figure 3:
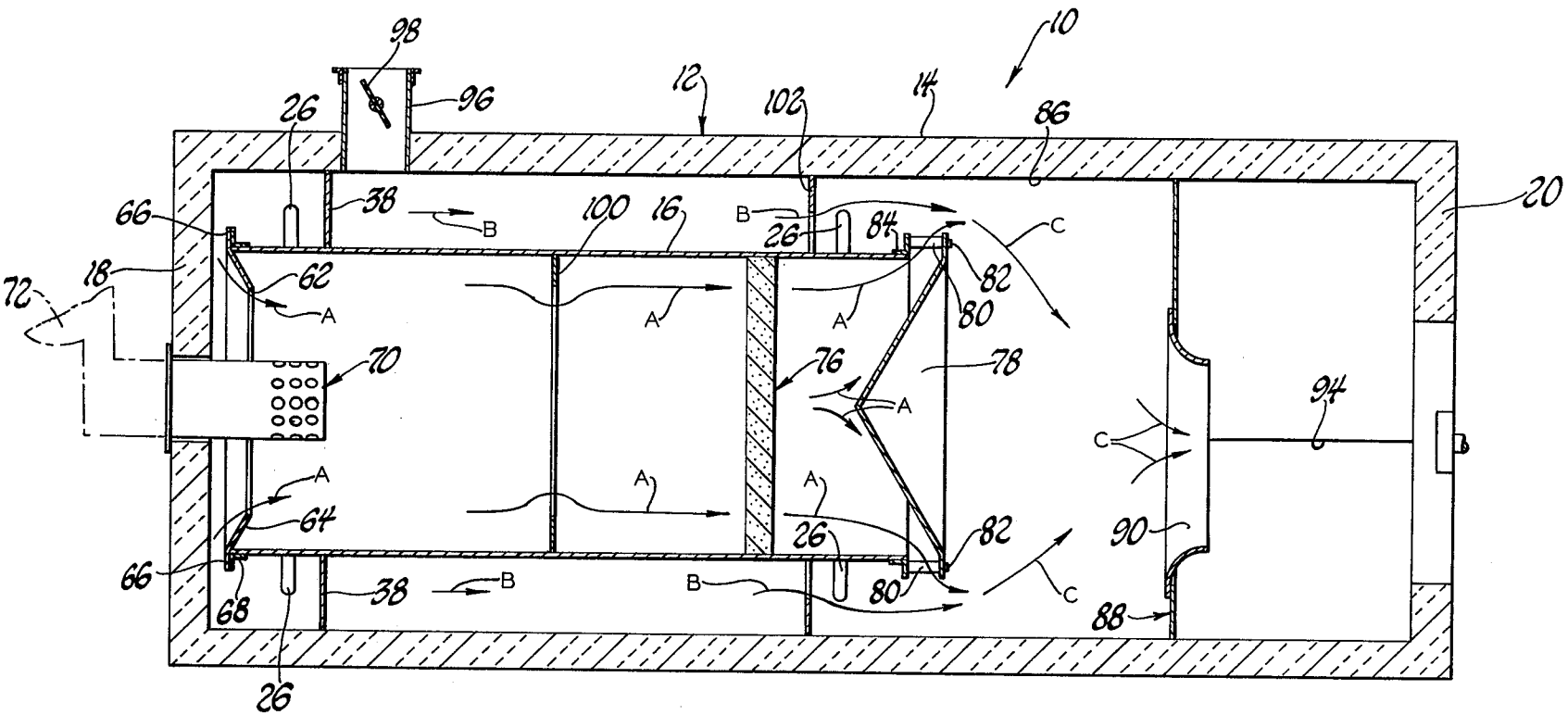
FIG. 3 is an elevation view of the heater taken in section along line 3—3 of FIG. 2.

As seen in FIG. 3, the gas A flowing along the first path of the housing enters the inner housing portion 16 at its upstream left-hand end through a central opening 62 in a frustoconical inlet member 64. An outer annular flange 66 of inlet member 64 is suitably secured such as by welding or rivets to an annular angle iron member 68 which is itself welded or riveted to the left-hand end of inner housing portion 16. A direct fired burner 70 mounted on the left-hand end wall 18 of the outer housing portion 14 extends into the inner housing portion 16 through the central hole 62 in inlet member 64. The burner 70 is fed fuel and air from a pump 72 (FIGS. 1 and 2) mounted adjacent a control panel 74. Preferably, the burner 70 and pump 72 can use either natural gas or oil as a fuel, whichever is more readily available at the time, in order to provide a burning flame that comes in direct contact with the gas A flowing through the inner housing portion 16.

Downstream from the burner 70 as best shown in FIG. 3, the inner housing portion 16 receives a catalytic converter 76 through which the gas A flowing along the first housing path must pass. The catalytic converter includes a suitable oxidizing catalytic agent such as a precious metal in the form of platinum and/or palladium etc. for removing unburned combustible gas contaminants as gas A passes through the converter while providing additional heating. For example, unburned hydrocarbons and carbon monoxide will be converted to carbon dioxide and water by the converter and in doing so will cause the additional heating of gas A. This additional heating supplements the heat supplied by the burner 70 and makes the heater highly efficient while the removal of the combustible gases makes the processing gas ready for use in a processing oven where such combustible gases are undesirable.

With continuing reference to FIG. 3, the gas A impinges with a mixing member 78 after leaving the catalytic converter. Axial supports 80 mount the mixing member 78 on the downstream end of inner housing portion 16 and are spaced circumferentially about the central axis of the inner housing portion. Bolts 82 detachably secure the supports 80 to an annular angle iron member 84 on the right-hand downstream end of housing portion 16 so that the mixing member 78 can be removed for access to the catalytic converter such that its catalytic agent can be cleaned or replaced as necessary. Mixing chamber 78 has a conical shape that points toward the upstream left-hand end of the inner housing portion 16 where the burner 70 is located. The pointed configuration of mixing member 78 directs the gas A outwardly in a radial direction so it impinges with the gas B flowing between the outer and inner housing portions for mixing therewith within a mixing chamber 86 defined by the outer housing portion, this chamber being accessible through an access door 87 shown in FIGS. 1 and 2. The mixing chamber 86 provides a junction for the two gas flow paths where the hotter gas A that has been heated mixes with the cooler gas B to provide a mixed gas C whose temperature is between that of gases A and B just before the mixing. Normally, the gas A must have a temperature within the range of about 600°-1200° F prior to passing through the catalytic converter 76 in order for the converter to function effectively and, after mixing of gas A with gas B, the mixed gas C will have a temperature in the range of 150°-500° F. A suction blower 88 downstream from the mixing chamber 86 has an inlet 90 and is driven by a drive mechanism 92, FIG. 2, to deliver the mixed gas C to an outlet of the housing provided by a duct 94 through the outer housing portion 14.

As seen in FIGS. 1 and 3, a fresh air inlet 96 of the outer housing portion 14 is located just to the right of the housing wall 38 and admits fresh air into the housing for mixing with the gas B flowing between the outer and inner housing portions along the second path of the housing. An adjustable damper 98 controls the rate at which the fresh air is admitted into the housing.

Figure 4:
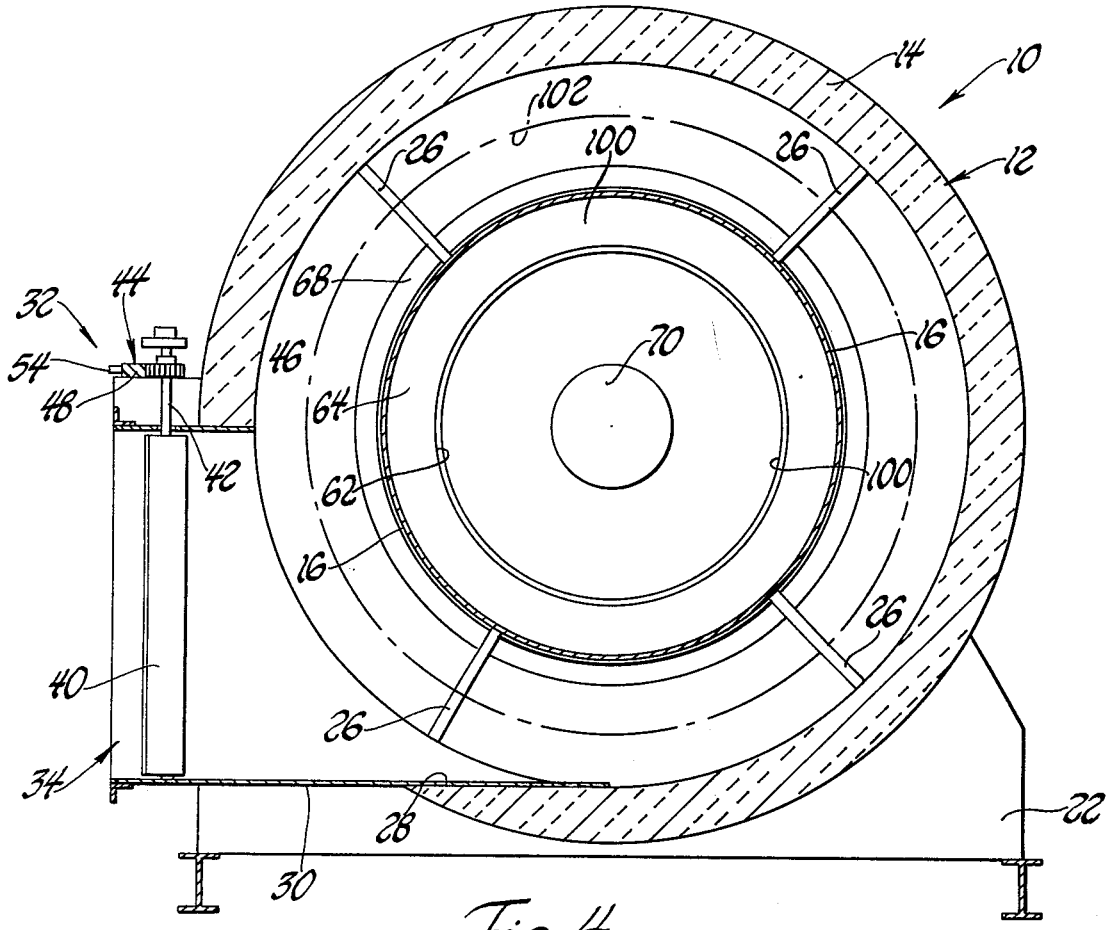
FIG. 4 is a cross-sectional view of the heater taken along line 4—4 of FIG. 1.

With combined reference to FIGS. 3 and 4, first and second annular baffles 100 and 102 are respectively positioned along the flow paths of gases A and B and each has a flat construction. Baffle 100 is mounted within the inner housing portion 16 between the burner 70 and the catalytic converter 76 in an inwardly extending direction. A sufficiently large pressure of gas A is generated about the burner 70 to provide heating thereof by the baffle 100 so as to help in maintaining the efficiency of the heater. Likewise, baffle 102 is mounted on the outer housing portion upstream from the mixing member 78 and downstream from fresh air inlet 96 in an inwardly extending direction. Baffle 102 causes the gas B flowing upstream thereof between the outer and inner housing portions 14 and 16 to have a sufficient pressure so that some heat is transferred outwardly through the stainless steel material of the inner housing portion from gas A to gas B by a combined conduction and convection heat flow. The gas B is thus heated to some extent as it flows from the left to the right prior to mixing with gas A to form the mixed gas C. While heat transfer is permitted through the noninsulated inner housing portion 16, the insulated outer housing portion 14 prevents the loss of heat from the housing 12 to the environment.

Figure 5:
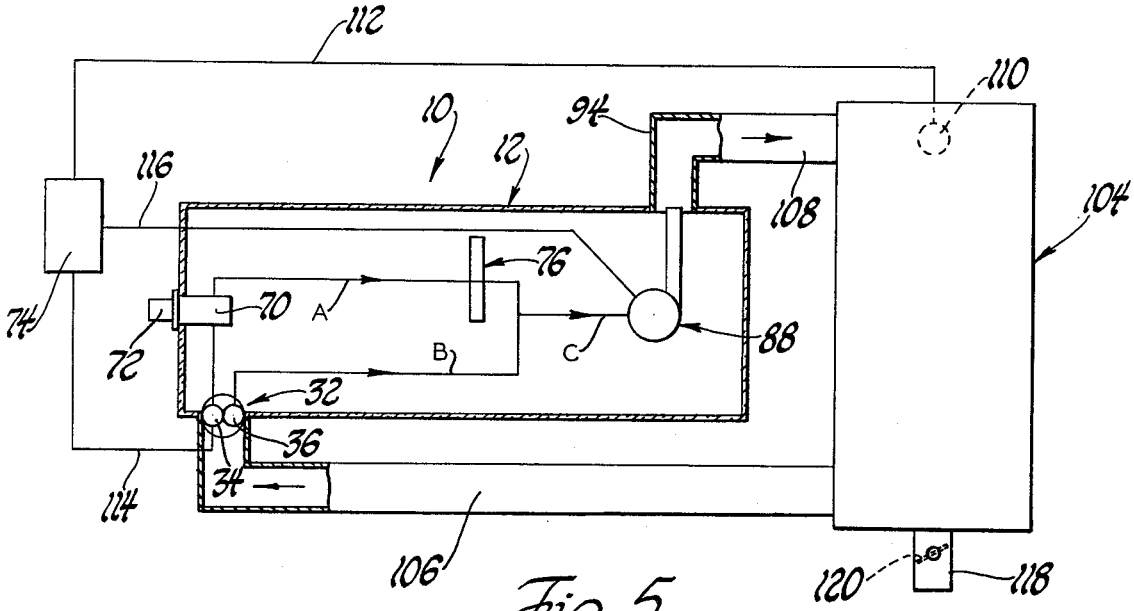
FIG. 5 is a schematic view illustrating the way in which the heater is utilized with a processing oven to provide heating of gas that is recirculated through the oven.

With reference to the schematic view of FIG. 5, the heater 10 is utilized with a processing oven 104 such as a paint oven or an oven of a meat processing system. Used gas travels from the oven 104 through a duct 106 to the inlet duct 30 of the heater housing 12. At duct 30, the valves 34 and 36 of valve mechanism 32 control the relative mass flow rates of gases A and B along the first and second parallel flow paths of the housing prior to being mixed into the gas C. It should be noted that the phrase "parallel paths" as herein used is meant to distinguish from two paths in "series", one following the other, rather than to mean flow paths along two lines that are oriented in the same direction; however, in the preferred embodiment the latter parallel relationship of the flow paths is true as well. Mixed gas C is fed by the suction blower 88 to the housing outlet provided by duct 94 and is delivered from duct 94 through a duct 108 back to the oven 104. A sensor 110 within oven 104 is responsive to the temperature of processing gas delivered to the oven and is coupled by a wire 112 to the control panel 74. Control panel 74 is coupled by a conduit 114 to actuate the power operated valve 34 in order to control the relative amount of gas A that is heated by the burner 70 and catalytic converter 76. Thus, if the processing gas delivered to the oven is too hot, valve 34 will be partially closed so that less gas A flows by the burner and through the catalytic converter while this valve will be opened to permit more gas A to flow if the processing gas within the oven has too low a temperature. While valve 34 will thus be normally opening and closing during operation of the processing oven in order to maintain the proper temperature, valve 36 will normally be manually adjusted to one position and to the amount of gas B flowing therethrough will only be changed by the relative pressure changes caused by adjustment of valve 34. Control panel 74 is also coupled by a wire 116 to the heater blower 88 to begin and terminate its operation. During this operation, a gas exhaust 118 of the oven with an adjustable damper 120 allows a certain portion of the processing gas to flow outwardly to be replaced by the fresh air that is introduced.

While a preferred embodiment of the heater has herein been described in detail, those skilled in the art will recognize various alternative designs and embodiments for practicing the present invention as defined by the following claims.

What is claimed is:

1. A recirculating processing oven heater comprising: a housing for receiving processing gas from a processing oven; said housing defining first and second paths along which the gas flows; a direct fired burner disposed along the first path to heat gas flowing therealong; a catalytic converter disposed along the first path downstream from the burner to remove unburned combustible gas therefrom and to thereby provide additional heating of gas flowing therealong; the second path of the housing means being in a parallel relationship to the first path along the flow length thereof over which the burner and the catalytic converter are disposed; the first and second flow paths having a junction downstream from the catalytic converter where mixing of the gas flowing along the two paths takes place in preparation for delivery to the processing oven; the housing including a hollow outer portion and a hollow inner portion received within the outer portion in a spaced relationship thereto so as to define the second gas flow path therebetween; said inner housing portion having a first end receiving the burner and a second end located at the junction of the first and second gas flow paths; the inner housing portion defining the first flow path between its ends and receiving the catalytic converter therebetween; a wall extending between the outer housing portion and the inner housing portion at the first end thereof such that the housing portions cooperate to define the first gas flow path upstream of the burner within the first inner housing portion end; a mixing member at the second end of the inner housing portion; the outer housing portion defining a chamber about the second end of the inner housing portion whereby the mixing member causes mixing within the chamber of the heated gas flowing along the first path with the gas flowing along the second path; the housing including first and second baffles respectively located along the first and second flow paths upstream from the mixing chamber; the inner and outer housing portions having elongated shapes that are round in cross section; the first and second baffles having annular shapes respectively mounted within the inner housing portion and between the inner and outer housing portions; the mixing member having a conical shape pointing toward the first end of the inner housing portion from the second end thereof to provide uniform mixing of the gas within the chamber; means for controlling the relative mass flow rates of gas along the first and second paths; a blower received within the outer housing portion downstream from the junction of the first and second flow paths at the mixing chamber; and an adjustable fresh air inlet located along the second flow path upstream from the second baffle.

2. A heater as claimed in claim 1 wherein the outer housing portion is constructed from an insulating material and the inner housing portion is constructed from a metallic material.

3. A recirculating processing oven heater comprising: a housing including an insulated outer portion of a hollow elongated shape with a round cross section and a noninsulated inner portion of a hollow elongated shape with a round cross section received within the outer housing portion in a coaxial spaced relationship; said inner housing portion including first and second ends and said outer housing portion including an inlet adjacent the first end of the inner housing portion as well as defining a mixing chamber adjacent the second end thereof; a control valve mechanism including first and second adjustable control valves for respectively feeding gas from the housing inlet to the first end of the inner housing portion and to between inner and outer housing portions to thereby establish first and second gas flow paths through the housing to the mixing chamber; each control valve including a plurality of dampers and an adjustable actuator for moving the dampers so as to vary the relative mass flow rates of gas along the first and second paths; a direct fired burner received within the first end of the inner housing portion to heat gas flowing along the first path; a catalytic converter located between the first and second ends of the inner housing portion downstream from the burner to remove combustible gas flowing along the first path and to thereby provide additional heating of gas flowing therealong; a mixing member of a conical shape mounted on the second end of the inner housing portion pointing toward the first end thereof to cause mixing of the gas flowing along the first and second paths upon reaching the mixing chamber; an adjustable fresh air inlet in the outer housing portion adjacent the first end of the inner housing portion; an outlet in the outer housing portion of the housing for delivering mixed gas from the housing chamber to the processing oven; and a blower received within the outer housing portion downstream from the mixing chamber for feeding the mixed gas from the chamber to the outlet.

4. A heater as claimed in claim 3 further including first and second baffles for the first and second gas flow paths, the first baffle having a flat construction with an annular shape mounted on the inner housing portion extending inwardly between the burner and the catalytic converter, and the second baffle having a flat construction with an annular shape mounted on the outer housing portion extending inwardly toward the inner housing portion upstream from the mixing chamber and downstream from the fresh air inlet.

5. A heater as claimed in claim 3 further including axial supports that mount the conical mixing member on the second end of the inner housing portion, and radial supports that mount the inner housing portion within the outer housing portion.

* * * * *